United States Patent [19]

Ito et al.

[11] Patent Number: 4,755,780

[45] Date of Patent: Jul. 5, 1988

[54] FERROMAGNETIC RESONATOR HAVING TEMPERATURE COMPENSATION MEANS USING PRE-CODED COMPENSATION DATA

[75] Inventors: Seigo Ito, Tokyo; Yoshikazu Murakami, Kanagawa; Tomikazu Watanabe, Tokyo; Takahiro Ohgihara, Kanagawa, all of Japan

[73] Assignee: Sony Corporation, Tokyo, Japan

[21] Appl. No.: 101,646

[22] Filed: Sep. 28, 1987

[30] Foreign Application Priority Data

Sep. 29, 1986 [JP] Japan ..... 61-231004

[51] Int. Cl.[4] ..... H01P 1/30; H01P 7/00

[52] U.S. Cl. ..... 333/234; 333/219; 333/235

[58] Field of Search ..... 333/202, 204, 219, 229, 333/234, 205, 24.2, 245, 246, 235, 148, 149; 331/96, 107 DP, 117 D, 177 R; 335/217, 218

[56] References Cited

U.S. PATENT DOCUMENTS 4,701,729 10/1987 Ito et al. ..... 333/219

*Primary Examiner*—Marvin L. Nussbaum

[57] ABSTRACT

A ferrimagnetic resonator is disclosed which is stabilized upon temperature deviation and operable over a wide frequency range. The resonator comprises a ferrimagnetic thin film resonance element, a temperature detector for the resonance element a bias magnetic field generating coil, a compensation coil and a compensation circuit. The compensation circuit has a pre-coded compensation data upon operation temperature range and generates a compensation signal in response a detected temperature of the resonance element. The compensation signal is then fed to the compensation coil to generate an additional magnetic field to the resonance element thus the resonance frequency of the resonance element is stabilized upon temperature.

7 Claims, 7 Drawing Sheets

FERROMAGNETIC RESONATOR HAVING TEMPERATURE COMPENSATION MEANS USING PRE-CODED COMPENSATION DATA

BACKGROUND OF THE INVENTION

The present invention generally relates to a ferromagnetic resonator device using ferrimagnetic resonance of a ferrimagnetic thin film and more particularly to a ferrimagnetic resonator having temperature compensation.

There has been proposed a ferromagnetic resonator for use in a microwave device as a filter or an oscillator. Such a ferromagnetic resonator is formed by forming a ferrimagnetic thin film, such as, YIG (Yttrium Iron Garnet) thin film through a liquid phase epitaxial growth on a nonmagnetic GGG (Gadolinium Gallium Garnet) substrate, and selectively etching the YIG thin film through a photolithographic process in a desired shape such as a disk shape or a rectangular shape. Such a microwave device has advantages that the microwave device can be formed in a MIC (microwave integrated circuit) having microstrip lines as transmission lines and that the microwave device can be connected easily with other MIC to form a hybrid circuit. Employment of a resonator element using an YIG thin film has advantages over a resonator element using an YIG sphere in that the YIG thin film can be formed through a mass-production process employing lithography techniques.

Such ferromagnetic resonator using a ferrimagnetic thin film has already proposed in U.S. Pat. Nos. 4,547,754, 4,636,756 and U.S. Ser. No. 844,984 filed Mar. 27, 1986 and now U.S. Pat. No. 4,679,015. Applications of such ferromagnetic resonator for a tuner and a oscillator are also proposed in U.S. Ser. No. 740,899 filed June 3, 1985, and now U.S. Pat. No. 4,704,739, and U.S. Pat. No. 4,626,800, all assigned to the assignee of the present application.

However, the ferromagnetic resonator employing a ferrimagnetic resonator element having an YIG thin film has a practical problem that the characteristics thereof is highly dependent on temperature.

The temperature characteristics of such a ferromagnetic resonator will be explained hereinafter.

The resonant frequency f of a ferrimagnetic resonator element employing, for example, an YIG thin film when a DC magnetic field is applied thereto in a direction perpendicular to the major surface of the YIG film is expressed by Kittel's equation:

$$f=\gamma\{Hg-(Nz-N_T)\cdot 4\pi Ms(T)\} \quad (1)$$

on an assumption that the influence of the anisotropy field is negligibly small, where Y is gyromagnetic ratio, which is 2.8 MHz/Oe for the YIG thin film, Hg is a DC bias magnetic field applied to the YIG thin film, Nz and $N_T$ are demagnetizing factors with respect to the direction of the DC magnetic field and a transverse direction, respectively, where $(Nz-N_T)$ is calculated on the basis of a magnetostatic mode theory, and $4\pi Ms$ is the saturation magnetization of the YIG thin film, which is a function of temperature T. In a numerical example, $Nz-N_T=0.9774$ for the perpendicular resonance of an YIG thin film having an aspect ratio (thickness/diameter) of 0.01. If the bias magnetic field Hg is constant regardless of temperature variation, the width of the range of variation of the resonant frequency f is as wide as 712 MHz in a temperature range of 0° C. to +70° C. because the saturation magnetization $4\pi Ms$ of the YIG thin film is 1844G (Gauss) at 0° C. and 1584G at +70° C.

We previously proposed YIG thin film microwave devices intended to solve the problems arising from the temperature characteristics in U.S. Ser. No. 708851 filed Mar. 6, 1985, and now U.S. Pat. No. 4,701,729, U.S. Ser. No. 883603 filed July 9, 1986, and U.S. Ser. No. 883605 filed July 9, 1986.

The temperature characteristics of the YIG thin film microwave devices we proposed are compensated by using a permanent magnet for applying a bias magnetic field to the YIG thin film resonator element according to the operating frequency of the ferrimagnetic resonator, or a bias magnetic circuit comprising a permanent magnet and a soft magnetic plate having a specific temperature coefficient. However, these inventions are applicable to YIG thin film microwave devices of a fixed frequency band type or of a narrow variable frequency band type, and are not capable of application to YIG thin film microwave devices of a widely variable frequency band type. That is, the temperature characteristics compensating method proposed in former Patent Applications had been developed on an assumption that the temperature of the YIG thin film and that of the permanent magnet or soft magnetic plate of the magnetic circuit are substantially the same.

However, an electromagnet having a coil to be energized to generate a magnetic field is employed instead of a permanent magnet, the heat generated by the energized coil causes comparatively large temperature difference between the YIG thin film and the magnetic circuit, and further between the components, for example, between the magnet and soft magnetic plate, of the magnetic circuits, and thereby the foregoing assumption becomes invalid Accordingly, the foregoing temperature compensating method based on an assumption that the temperature of the ferrimagnetic resonator element and that of the magnetic circuit are on the same order is inappropriate to the ferromagnetic resonator of a widely variable frequency band type in which the magnitude of the current supplied to the electromagnet for applying a DC magnetic field to the ferrimagnetic resonator element is varied over a comparatively wide range.

Furthermore, in a strict sense or depending on the ambient conditions, the temperature of the ferromagnetic resonator element is different from that of the permanent magnet or the magnetic circuit also when the ferromagnetic resonator employs a permanent magnet for applying a DC bias magnetic field to the ferrimagnetic resonator element. Therefore, the temperature characteristics compensating method based on an assumption that there is no temperature difference between those components is not satisfactorily applicable even to the ferromagnetic resonator employing a permanent magnet.

A temperature compensating method for an oscillator employing a dielectric resonator is disclosed, for example, in 1984 IEEE MTT-S International Microwave Symposium Digest, pp. 277–279 (hereinafter referred to as "Reference 1"). This invention is based on an idea different from that of the Reference 1, which will become apparent from a description which will be given hereinafter.

OBJECT AND SUMMARY OF THE INVENTION

It is an object of the present invention to provide an improved ferromagnetic resonator device utilizing a ferrimagnetic thin film.

It is another object of the present invention to provide a ferromagnetic resonator for use in wide frequency band.

It is further object of the present invention to provide a ferromagnetic resonator having stabilized frequency characteristics upon temperature deviation.

It is still further object of the present invention to provide a ferromagnetic resonator having stabilized frequency characteristics over wide frequency range upon temperature deviation.

According to one aspct of the present invention there is provided a ferromagnetic resonator which comprises a ferrimagnetic resonance element formed of a ferrimagnetic thin film, a bias magnetic field means applying a D.C. bias magnetic field perpendicular to a major surface of the ferrimagnetic thin film, a temperature detector detecting temperature of the ferrimagnetic resonance element, and a compensation circuit having a pre-coded compensation data and deriving a compensation signal in response to the detected temperature and a coil means generating a compensation magnetic field applied to the ferrimagnetic resonance element supplied with a compensation current in response to the compensation signal.

DESCRIPTION OF THE PREFERRED EMBODIMENTS

Figure 1:
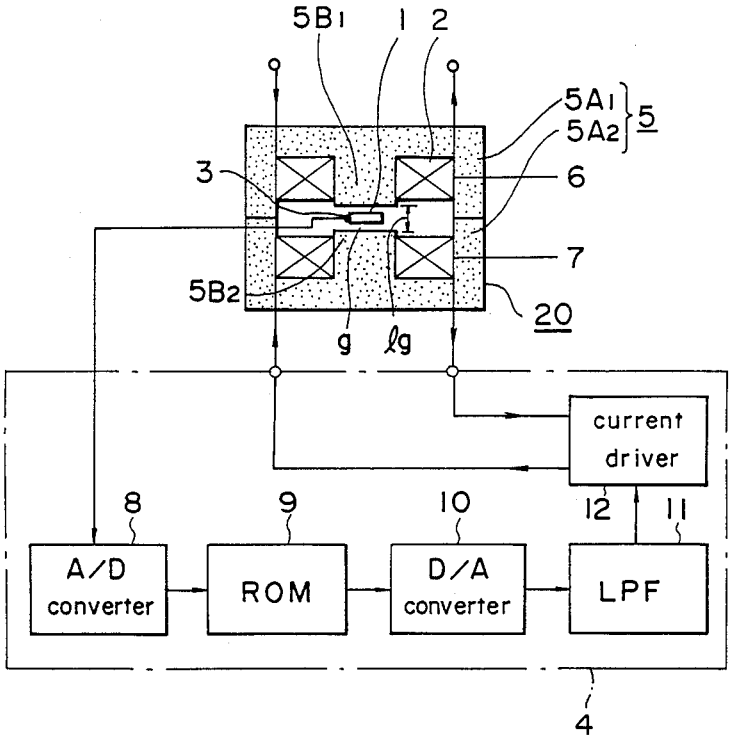
FIGS. 1 and 2 are block diagrams showing ferromagnetic resonators according to the present invention.

A ferromagnetic resonator according to the present invention comprises, for example, as shown in FIG. 1, a ferrimagnetic resonator element 1, an electromagnet 2 which applies a DC bias magnetic field to the ferrimagnetic resonator element 1, a temperature detector 3 which detects the temperature of the ferrimagnetic resonator element 1, and a compensating current supplying circuit 4 which supplies a compensating current corresponding to the temperature of the ferrimagnetic resonator element 1 detected by the temperature detector 3 to the electromagnet 2.

According to the present invention, the temperature detector 3 provides a detection output corresponding to the temperature of the ferrimagnetic resonator element 1, and then the compensating current supplying circuit 4 supplies a necessary current corresponding to the detection output of the temperature detector 3 to the electromagnet 2 to eliminate the temperature-dependent term of equation (1), so that the temperature-dependent variation of the resonant frequency f is avoided.

A ferromagnetic resonator, in a first embodiment, according to the present invention will be described hereinafter with reference to FIG. 1, in which indicated at 20 is a ferromagnetic resonator having a ferrimagnetic resonator element 1. In this embodiment, the ferromagnetic resonator 20 is provided with a magnetic circuit 5 having a pair of bell-shaped magnetic cores $5A_1$ and $5A_2$ such as magnetic ferrite cores respectively having outer circular wall portions and central magnetic poles $5B_1$ and $5B_2$ and disposed opposite to each other with the respective axes of the central magnetic poles $5B_1$ and $5B_2$ in alignment with the internal axis of the ferromagnetic resonator 20.

An electromagnet 2 is formed by mounting a frequency control coil 6 of $N_1$ turns and a temperature compensating coil 7 of $N_2$ turns on the respective central magnetic poles $5B_1$ and $5B_2$ of the cores $5A_1$ and $5A_2$ of the magnetic circuit 5, respectively.

The ferrimagnetic resonator element 1, for example, an YIG thin film element, is disposed in a magnetic gap g of $l_g$ in length formed between the central magnetic poles $5B_1$ and $5B_2$ of the magnetic circuit 5.

A temperature detector 3, for example, a thermistor, is disposed near the ferrimagnetic resonator element 1.

The frequency control coil 6 of the electromagnet 2 is connected to a variable current source (not shown). The current $I_1$ to be supplied to the coil 6 is controlled to vary the DC bias magnetic field applied to the resonator element 1 in order to decide selectively the resonance frequency, namely, the operating frequency, of the resonator element 1.

The temperature compensating coil 7 is connected to a compensating current supply circuit 4.

In the circuit 4, and A/D converter 8 for converting analog signals into corresponding digital signals receives a voltage signal representing the temperature of the ferrimagnetic resonator element 1 from the temperatur detector 3, and then applies a digital temperature data corresponding to the voltage signal to an address bus of a ROM (read-only memory) 9. Temperature compensating data is stored beforehand in the ROM 9. Then, a temperature compensating data for temperature compensation is read through the data bus from the ROM 9. A D/A convertor 10 converts the temperature compensating data into a corresponding analog data, and then gives the analog data, if necessary, through a low-pass filter 11 for filtering to reduce the sampling frequency component to a current driver 12. Then, the current driver 12 supplies a compensating current $I_2$ to the temperature compensating coil 7.

In such an operation, a magnetic field to be applied to the ferromagnetic resonator element 1, namely, the gap magnetic field Hg in the magnetic gap g is expressed by:

$$Hg = H_1 \cdot I_1 / l_g + N_2 \cdot I_2 / l_g \quad (2)$$

The magnitude of the compensating current $I_2$ to be supplied from the compensating current supplying circuit 4 to the temperature compensating coil 7 to compensate the variation of the resonant frequency of the ferromagnetic resonator element 1, namely, to compensate the temperature-dependent term of equation (1), is decided so as to meet an expression:

$$N_2 \cdot I_2 / l_g = (Hz - N_T) \cdot 4\pi MS(T) \quad (3)$$

Therefore, from equations (1), (2) and (3), the resonant frequency f of the ferromagnetic resonator element 1 is expressed by:

$$f=\gamma\cdot N_1\cdot I_1/l_g \quad (4)$$

eliminating the temperature-dependent term, and hence the resonant frequency f can be decided uniquely by the current $I_1$ supplied to the frequency control coil 6.

As mentioned abov, the compensating data is stored beforehand in the ROM 9 to make the compensating current supplying circuit 4 supply the current $I_2$ satisfying equation (*4*). The compensating data is arranged, for example, so as to make the ferrimagnetic resonator element 1 operate at a fixed frequency $f_s$ of, for example, 1.8 GHz. The operating frequency of the ferromagnetic resonator element is detected by a network analyzer. In this state, a predetermined temperature is given to find a digital data for supplying a current which makes $f_0=f_s=1.8$ GHz to the temperature compensating coil 7. Then, the digital data and a digital data corresponding to the detected temperature are stored in one-to-one correspondence in the ROM. This operation is executed for temperatures in a range of operating temperatue and data thus obtained is written in the ROM.

Thus, the ferromagnetic resonator of the present invention provided with the temperature compensating coil 7 and the compensating current supplying circuit 4 for supplying a compensating current $I_2$ corresponding to the variation of the temperature of the ferrimagnetic resonator element 1 is capable of completely eliminating temperature-dependent factors causing the temperature-dependent variation of the resonance frequency. Particularly, when data decided so as to make the ferrimagnetic resonator element 1 operate at a fixed frequency $f_s$ regardless of temperature variation is stored in the ROM as mentioned above, the temperature-dependent variation of the operating frequency can be suppressed irrespective of the level of operating frequency even when the ferromagnetic resonator is operated in a widely variable frequency band. The suppression of the temperature-dependent variation of the operating frequency of the ferromagnetic resonator element 1 is possible when the relation between the resonance frequency and the gap magnetic field in equation (1), namely, the relation between the bias magnetic field and the current supplied to the coil, is linear, which is one of the features of the present invention.

It is another feature of the present invention that the compensation of the temperature-dependent variation of the resonance frequency is fed back directly to the gap magnetic field controlling the resonant frequency, namely, to the bias magnetic field applied to the ferrimagnetic resonator element 1.

In this embodiment, the temperature compensation is applied to all the factors relating to the variation of the resonant frequency including the saturation magnetization $4\pi Ms$ of the ferrimagnetic resonator element 1 included in equation (1). The ferromagnetic resonator may be constituted so as to compensate only the temperature-dependent variation of the saturation magnetization. Since the saturation magnetization $4\pi Ms(T)$ of the ferromagnetic resonator element can be divided into a fixed part $4\pi Ms^0$ and a temperature-dependent variable part $\Delta 4\pi Ms(T)$, equation (1) can be changed into an expression:

$$f=\gamma\{Hg-(Nz-N_T)\cdot 4\pi Ms^0-(Nz-N_T)\cdot\Delta 4\pi Ms(T)\} \quad (5)$$

When the compensating current $I_2$ is decided so as to meet an expression:

$$N_2\cdot I_2/l_g=(Nz-N_T)\cdot\Delta 4\pi Ms(T) \quad (6)$$

instead of equation (3), from equations (2), (5) and (6), $$f=\gamma\cdot N_1\cdot I_1/l_g-\gamma(Nz-N_T)\cdot 4\pi Ms^0 \quad (7)$$

As shown by equation (7), since the resonance frequency f includes a fixed term $-\gamma(Nz-N_T)\cdot 4\pi Ms^0$, the resonance frequency is not simply proportional to the frequency control current $I_1$. However, the resonance frequency f is decided uniquely by the frequency control current $I_1$ and is not dependent on temperature.

Figure 3:
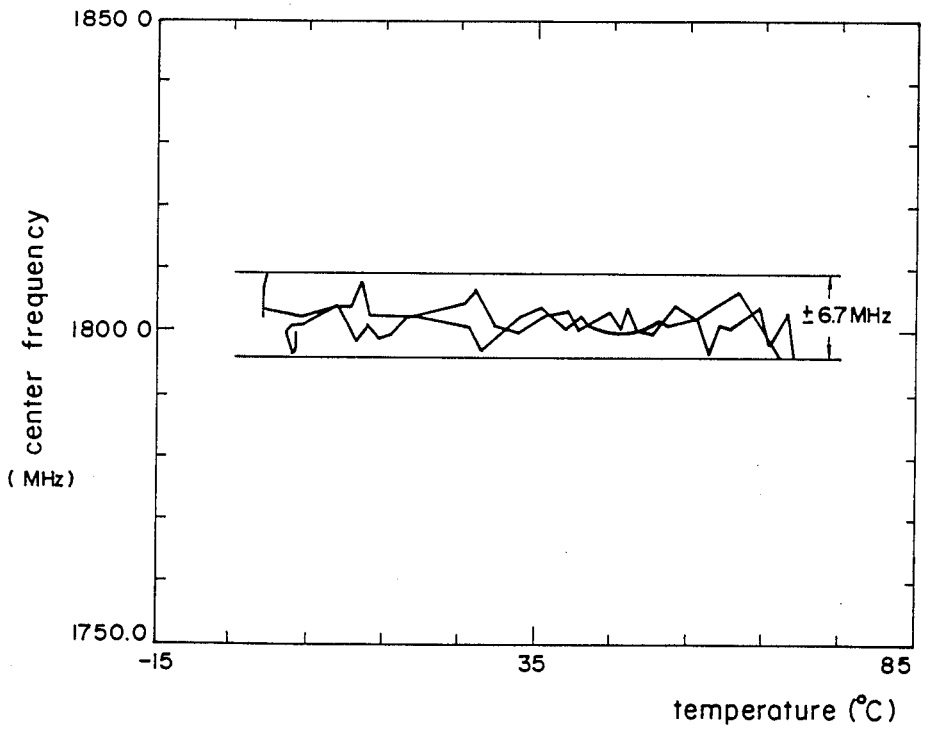
FIGS. 3 to 5 are graphs showing measured results of center frequencies upon temperature deviation.
Figure 4:
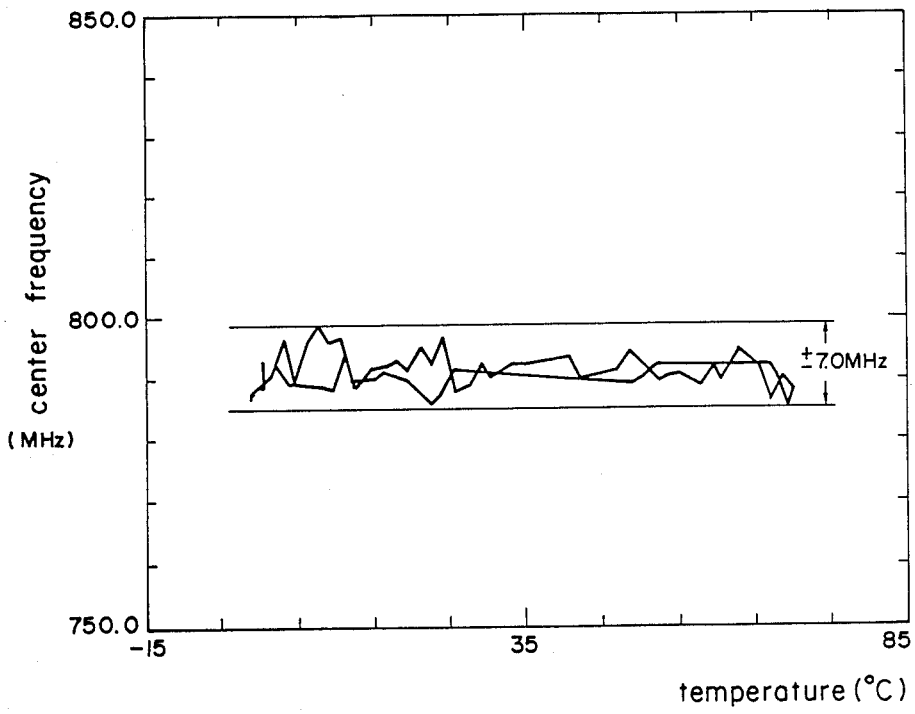
Figure 5:
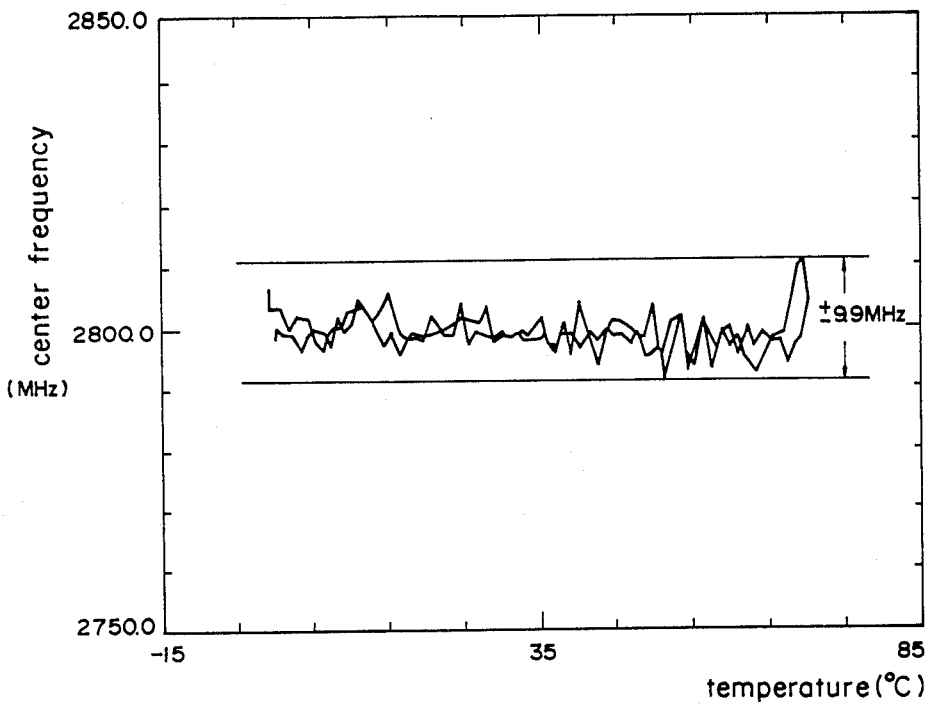

FIGS. 3, 4 and 5 are graphs showing the measured variation of the center frequency with temperature in an YIG variable frequency band-pass filter formed according to the present invention for a frequency band of 0.8 to 2.8 GHz, when the temperature was raised from 0° C. to 70° C. and then lowered to 0° C., temperature compensating data decided for a frequency of 1.8 GHz was stored in the ROM and the temperature compensating function was executed at 1.8 GHz, 0.8 GHz and 2.8 GHz.

Figure 8:
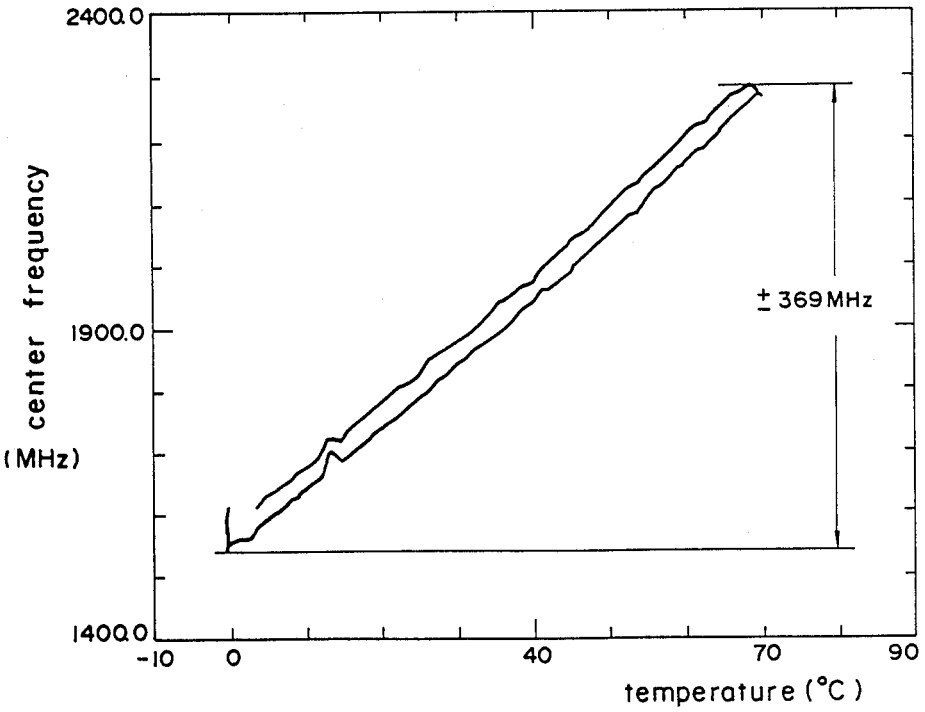
FIG. 8 is a graph showing a measured result of center frequency deviation upon temperature change without temperature compensation.

FIG. 8 is a graph showing the measured variation of the center frequency of 1.8 GHz with temperature, when the temperature was raised from 0° C. to 70° C. and then lowered to 0° C. and the temperature compensation was not applied. It is obvious from comparative observation of FIGS. 3, 4, 5 and 8 that the range of frequency variation was ±369 MHz when the temperature compensation was not applied (FIG. 8) and the temperature variation was suppressed effectively by temperature compensation to ±6.7 MHz (FIG. 3), ±7.0 MHz (FIG. 4) and ±9.9 MHz (FIG. 5).

Figure 6:
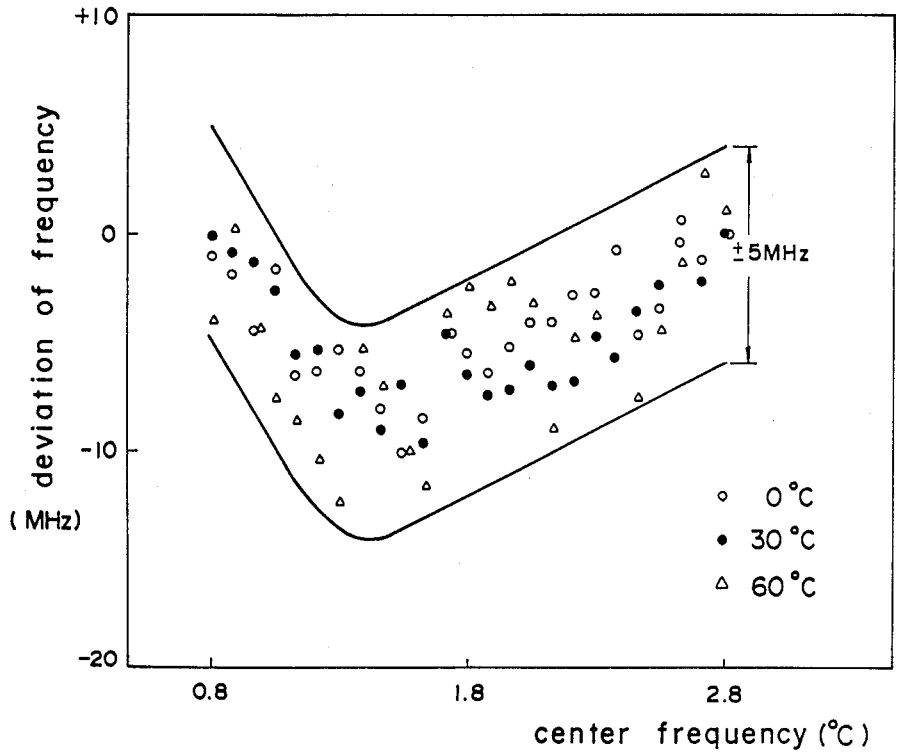
FIG. 6 is a graph showing frequency deviation upon change of center frequency at 0°, 30° and 60° C.

FIG. 6 shows the deviation of frequency from the expected frequency at 0° C., 30° C. and 60° C. measured through experimental frequency sweepage in a frequency band of 0.8 GHz to 2.8 GHz. In FIG. 6, measurements indicated by blank circles, solid circles and triangles are for 0° C., 30° C. and 60° C., respectively. The experiment provided that the temperature-dependent frequency variation is suppressed within ±5 MHz when the ferrimagnetic resonator of the present invention is used as a wide band variable frequency device.

Figure 2:
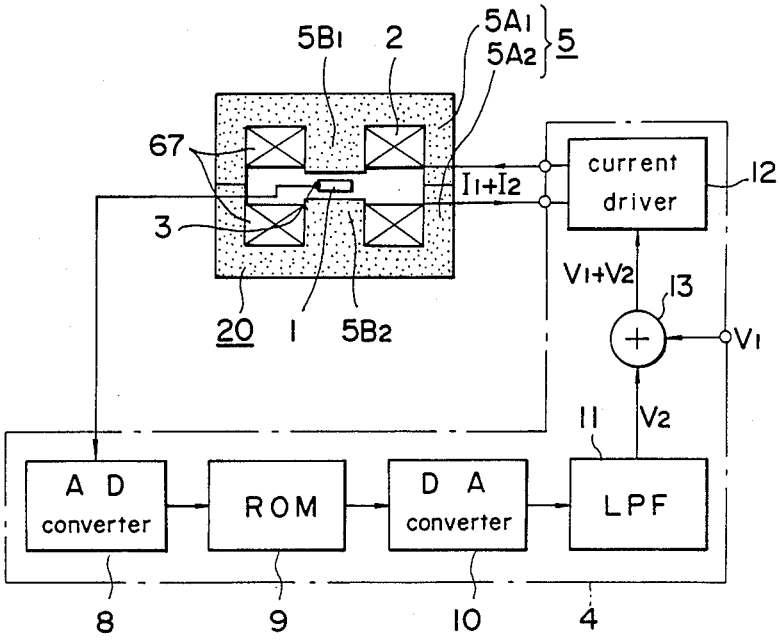

FIG. 2 shows a ferromagnetic resonator, in a second embodiment, according to the present invention. In FIG. 2, parts similar to or corresponding to those previously described with reference to FIG. 1 are denoted by the same reference numerals and the description thereof will be omitted. While the electromagnet 2 of the first embodiment comprises the frequency control coil 6 and the temperature compensating coil 7, an electromagnet 2 employed in the second embodiment has coils 67 serving as both those coils 6 and 7. In the second embodiment, an adder 13 adds a temperature compensating voltage $V_2$ provided by a low-pass filter 11 and a frequency control voltage $V_1$, and then applies the sum voltage $V_1+V_2$ to a current driver 12. Then, the current driver 12 supplies a current $I_1+I_2$ corresponding to the voltage $V_1+V_2$ to the coils 67. The second embodiment operates on the same principle of operation represented by equations (2), (3) and (4) as the first embodiment, except that the total number N of the windings of the coils 67 is substituted for $N_1$ and $N_2$ into equations (2), (3) and (4). Also in the second embodiment, the resonant frequency f is not affected by temperature variation and is decided uniquely by the control voltage $V_1$.

Figure 7:
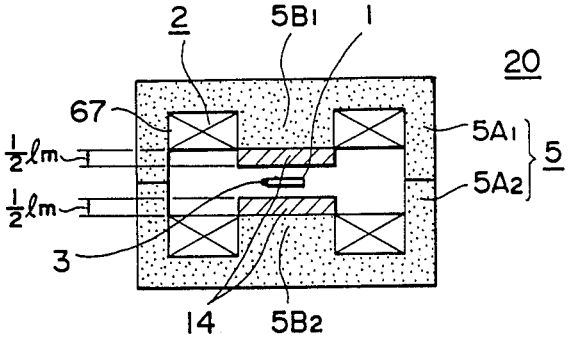
FIG. 7 shows further embodiment of a ferromagnetic resonator to which temperature compensation of the present invention is applied.

In the ferromagnetic resonator 20 in either of the first and second embodiments, a magnetic field is applied to the ferromagnetic resonator element 1 only by the electromagnet 2. The present invention is applicable further to a ferromagnetic resonator of a fixed frequency type in which a fixed magnetic field is applied to the ferrimagnetic resonator element 1 by a permanent magnet and a temperature compensating magnetic field is applied to the same by an electromagnet. FIG. 7 shows the constitution of such a ferromagnetic resonator, in a third embodiment, according to the present invention. In FIG. 7, parts similar to or corresponding to those previously described with reference to FIG. 1 are denoted by the same reference numerals and the description thereof will be omitted. In the third embodiment, a magnetic circuit 5 comprises magnetic cores $5A_1$ and $5A_2$ respectively having central magnetic poles $5B_1$ and $5B_2$, and permanent magnets 14 attached to the respective free ends of the central magnetic poles $5B_1$ and $5B_2$, respectively. A ferrimagnetic resonator element 1 is disposed in a magnetic gap formed between the permanent magnets 14.

Coils 67 are mounted on the central magnetic poles $5B_1$ and $5B_2$, respectively. The sum of the numbers of turns of the coils 67 is N. In the third embodiment, the resonant frequency f is expressed by:

$$f=\gamma\{Hg(T)-(Nz-N)_T 4\pi Ms(T)\} \quad (8)$$

The gap magnetic field Hg, namely, the magnetic field applied to the ferromagnetic resonator element 1 is:

$$Hg(T)=l_m Br(T)/\mu_r l_g+N\cdot I/l_g \quad (9)$$

where $l_m$, Br and $\mu_r$ are the thickness, remanence and recoil permeability, respectively, of the permanent magnets 14. When Br is expressed by a fixed part $Br^0$ and a variable part $\Delta Br(T)$ and the fixed part and the variable part are substituted for Br into equation (9), $$Hg(T)=l_m\{Br^0+\Delta Br(T)\}/\mu_r l_g+N\cdot I/l_g \quad (10)$$

The saturation magnetization $4\pi Ms$ also can be divided into a fixed part $4\pi Ms^0$ and a variable part $4\pi Ms(T)$. Therefore, $$4\pi Ms(T)=4\pi Ms^0+\Delta 4\pi Ms(T) \quad (11)$$

Substituting equations (10) and (11) into equation (8), we obtain:

$$f=\gamma\{l_m Br^0/\mu_r l_g-(Nz-N_T)\cdot 4\pi Ms^0+ l_m\Delta Br(T)/\mu_r l_g+N\cdot I/l_g-(Nz-N_T)\cdot\Delta 4\pi Ms(T)\} \quad (12)$$

Accordingly, when a current I meeting $$N\cdot I/l_g=(Nz-N_T)\cdot\Delta 4\pi Ms(t)-l_m\Delta Br(T)/\mu_r l_g \quad (13)$$

is supplied to the coils 67 by the magnetic circuit 4, the third and fourth terms of equation (12) are eliminated, and hence $$f=\gamma\{l_m Br^0/\mu_r l_g-(Nz-N_T)\cdot 4\pi Ms^0 \quad (14)$$

Thus, the resonance frequency f is maintained at a fixed level regardless of temperature As apparent from the foregoing description, according to the present invention, the temperature characteristics of the ferromagnetic resonator for wide band variable frequency also the ferromagnetic resonator of a fixed frequency type, are improved to avoid frequency variation attributable to temperature variation.

Furthermore, according to the present invention, the temperature-dependent variation of the resonance frequency is fed back directly to the gap magnetic field where the ferrimagnetic resonator element is disposed to compensate the temperature-dependent variation of the resonant frequency. Thus, the present invention is fundamentally different from the resonator employing an additional frequency control element such as varactor diode and adapted to feed back the temperature-dependent variation of the frequency to the frequency control element as mentioned in Reference 1. Therefore, the ferromagnetic resonator of the present invention is simplified remarkably in constitution as compared with the conventional ferromagnetic resonator. As mentioned above, the temperature-dependent variation of the frequency is eliminated irrespective of the operating frequency in using the ferromagnetic resonator as a wide band variable frequency device by using data prepared so as to provide a fixed operating frequency $f_s$ and stored in the ROM. This elimination of the temperature-dependent variation of the frequency is possible only when the relation between the resonance frequency and the gap magnetic field in equation (1), namely, the relation between the bias magnetic field and the coil current, is linear, which is based on a principle specific to the magnetic resonator. Accordingly, the variable frequency device employing a varactor diode as disclosed in Reference 1, for example, a VCO (voltage-controlled oscillator) in which the relation is not linear is not the objective device of the present invention. Thus, the present invention is a unique invention based on a principle specific to the magnetic resonator.

We claim as our invention:

1. A ferromagnetic resonator comprising;

a ferrimagnetic resonance element formed of a ferrimagnetic thin film, a bias magnetic field means applying a D.C. bias magnetic field perpendicular to a major surface of said ferrimagnetic thin film, a temperature detector detecting temperature of said ferrimagnetic resonance element, a compensation circuit having a pre-coded compensation data and deriving a compensation signal in response to the detected temperature by said temperature detector, and a coil means generating a compensation magnetic field applied to said ferrimagnetic resonance element supplied with a compensation current in response to said compensation signal.

2. a ferromagnetic resonator comprising;

a ferrimagnetic resonance element formed of a ferrimagnetic thin film, a bias magnetic field means applying a D.C. bias magnetic field perpendicular to a major surface of said ferrimagnetic thin film, a temperature detector provided with said ferrimagnetic resonance element detecting temperature of said ferrimagnetic resonance element, an analogue to digital converter converting signal of said temperature into a digital signal, a memory device having a pre-coded compensation data and deriving digital compensation data in response to receipt of said digital signal of detected temperature, a current driver generating a compensation current in response to said digital compensation data, and a coil fed with said compensation current and generating a compensation magnetic field applied to said ferrimagnetic resonance element perpendicular to said major surface of said ferrimagnetic thin film.

3. A ferromagnetic resonator according to claim 1 or 2, said ferrimagnetic thin film is formed of ferrimagnetic YIG thin film.

4. A ferromagnetic resonator according to claims 1 or 2, said bias magnetic means is an electromagnet including a coil and a current driver for generating said D.C. bias magnetic field.

5. A ferromagnetic resonator according to claim 1 or 2, said bias magnetic field means is a permanent magnet.

6. A ferromagnetic resonator according to claims 1 or 2, said pre-coded compensation data is obtained in such manner that said ferromagnetic resonator is operated at a fixed predetermined frequency under various temperature and additional currents to keep said fixed predetermined frequency required at respective temperatures are obtained and stored in a memory device.

7. A ferromagnetic resonator according to claims 1 or 2, a pair of magnetic cores each having a central magnetic pole and a circular wall portion facing to each other to make a gap between said central magnetic poles, and said ferrimagnetic resonance element is provided in said gap.

* * * * *